US012709310B2

(12) United States Patent
Wegmüller

(10) Patent No.: US 12,709,310 B2
(45) Date of Patent: Aug. 18, 2026

(54) ARTICULATED VEHICLE ARRANGEMENT FOR A RAIL FREIGHT TRAIN

(71) Applicant: SWS PS POWER SOLUTIONS GMBH, Graz (AT)

(72) Inventor: Beat Wegmüller, Huttwil (CH)

(73) Assignee: SWS PS POWER SOLUTIONS GMBH, Graz (AT)

( * ) Notice: Subject to any disclaimer, the term of this patent is extended or adjusted under 35 U.S.C. 154(b) by 514 days.

(21) Appl. No.: 18/252,272

(22) PCT Filed: Jun. 14, 2021

(86) PCT No.: PCT/EP2021/065929
§ 371 (c)(1),
(2) Date: May 9, 2023

(87) PCT Pub. No.: WO2022/100896
PCT Pub. Date: May 19, 2022

(65) Prior Publication Data

US 2023/0415792 A1 Dec. 28, 2023

(30) Foreign Application Priority Data

Nov. 10, 2020 (EP) ..... 20206753

(51) Int. Cl.
*B61D 3/20* (2006.01)
*B61C 3/02* (2006.01)
*B61G 5/10* (2006.01)

(52) U.S. Cl.
CPC ..... *B61D 3/20* (2013.01); *B61C 3/02* (2013.01); *B61G 5/10* (2013.01)

(58) Field of Classification Search
CPC ..... B61C 3/02; B61D 3/20; B61G 5/10
See application file for complete search history.

(56) References Cited

U.S. PATENT DOCUMENTS 4,667,603 A * 5/1987 Van Iperen ..... B61F 5/08 105/182.1
2019/0222054 A1* 7/2019 Zettel ..... B61D 3/20
2020/0062281 A1 2/2020 Brown et al.

FOREIGN PATENT DOCUMENTS

CN 201901145 U 7/2011
CN 207225347 U 4/2018
(Continued)

OTHER PUBLICATIONS

Chinese Office Action and English Machine Translation for Application 202180080804.5, sixteen pages, dated Dec. 20, 2023.
(Continued)

*Primary Examiner* — Robert J McCarry, Jr.
(74) *Attorney, Agent, or Firm* — Nixon & Vanderhye, PC

(57) ABSTRACT

An articulated vehicle arrangement for a rail freight train is disclosed including an articulated vehicle for the transporting of containers having a first vehicle part and a second vehicle part. The first and the second vehicle parts are coupled together by an articulated coupling about a vertical articulation axis. The first vehicle part includes on its top side a first container parking place for one or more containers and the second vehicle part includes on its top side a second container parking place for one or more containers, and further including a power supply unit for the power supply of containers loaded on the articulated vehicle.

13 Claims, 7 Drawing Sheets

(56) References Cited

FOREIGN PATENT DOCUMENTS

Figure 1:
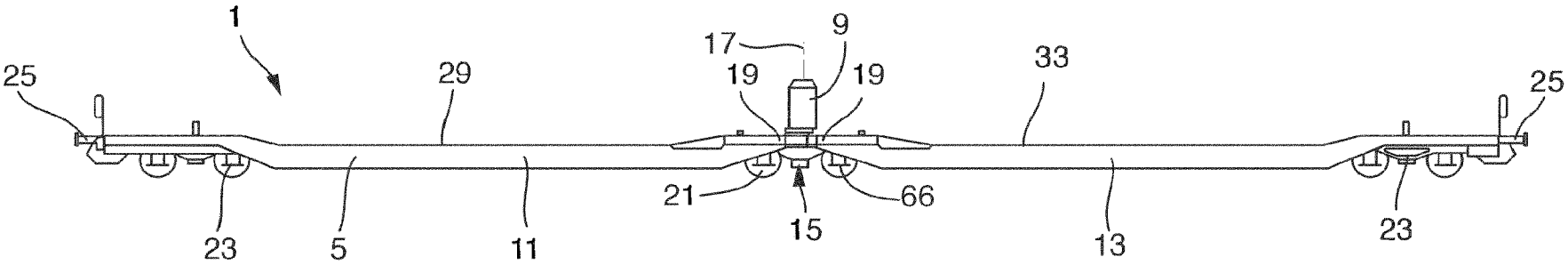

| | | | |
|---|---|---|---|
| CN | 110843805 | | 2/2020 |
| CN | 110884513 | | 3/2020 |
| CN | 111032473 | | 4/2020 |
| EP | 2 647 540 | A1 | 10/2013 |
| RU | 146904 | U1 | 10/2014 |
| RU | 176833 | U1 | 1/2018 |
| WO | 9721558 | | 6/1997 |
| WO | 2018190718 | | 10/2018 |
| WO | 2018190718 | A2 | 10/2018 |

OTHER PUBLICATIONS

International Search Report for PCT/EP2021/065929 mailed Sep. 3, 2021, 4 pages.
Written Opinion of the ISA for PCT/EP2021/065929, mailed Sep. 3, 2021, 6 pages.
Decision to Grant with English Translation for Russian Application No. 2023114030, 21 pages, dated Sep. 25, 2024.
Search Report with English Translation for Russian Application No. 2023114030, four pages, dated Sep. 24, 2024.

* cited by examiner

ARTICULATED VEHICLE ARRANGEMENT FOR A RAIL FREIGHT TRAIN

CROSS REFERENCE TO RELATED APPLICATIONS

The present application is a National Phase of International Application Number PCT/EP2021/065929 filed Jun. 14, 2021, which designated the U.S. and claims priority benefits from European Application Number EP 20206753.4, filed Nov. 10, 2020, the entire contents of each of which are hereby incorporated by reference.

The present invention relates to an articulated vehicle arrangement for a rail freight train, especially a container carrier arrangement. Further aspects of the invention relate to an articulated vehicle and a power supply unit for such an articulated vehicle arrangement.

The articulated vehicle arrangement encompasses an articulated vehicle for the transporting of containers including semi-trailers, especially a so-called container carrier (CTW), where the containers may be, for example, so-called reefer containers, tank containers, refrigerated swap bodies or refrigerated semi-trailers. The articulated vehicle comprises a first vehicle part and a second vehicle part, wherein the first and the second vehicle part are coupled together by an articulated coupling about at least one vertical articulation axis and are braced in the region of the articulated coupling at their mutually facing ends, preferably on a common bogie, especially a Jacobs bogie. Additional bogies are preferably provided at the ends of the two vehicle parts facing away from each other. The first vehicle part comprises on its top side a first container parking place for one or more containers and the second vehicle part comprises on its top side a second container parking place for one or more containers.

The articulated vehicle arrangement moreover comprises a power supply unit for the preferably autonomous power supply, in particular with electrical energy, of containers loaded on the articulated vehicle. Autonomous power supply means in this context a power supply which occurs without any or at least without a continuous power supply from the locomotive, another articulated vehicle, or the overhead contact line, preferably not having any corresponding connection to the locomotive, the other articulated vehicle, or the overhead contact line.

Similar articulated vehicle arrangements are known in the prior art. Such articulated vehicle arrangements are designed, among other things, to hold containers which are intended for the transporting of temperature-controlled freight, such as reefer containers, tank containers, refrigerated swap bodies or refrigerated semi-trailers. Such containers place high demands on the power supply, since on the one hand they have a large energy demand to operate the cooling or heating system and on the other hand they must assure a closed cooling or heating circuit, i.e., they require an uninterrupted power supply not only during movement, but also at standstill or in shunting and handling operations. Therefore, a power supply via neighbouring vehicles, locomotives, or overhead contact line is not ideal, since an uninterrupted power supply is not possible in this case, or at least not without reservations.

Moreover, articulated vehicle arrangements are known which have power supply units with batteries. Because of the high energy demand of the containers, however, such battery-operated power supply units are relatively large, so that it is a challenge to house the power supply unit. According to one known solution, the power supply unit is housed underneath the container parking place. But this has the disadvantage that the container bottom must be somewhat elevated and therefore less room overall is available for the containers, on account of the stringent height restrictions of a rail freight train, or certain containers cannot be transported.

Therefore, the problem of the present invention is to provide an articulated vehicle arrangement with which an uninterrupted power supply of loaded containers is easily possible even at standstill and in shunting operation and which has a maximum loading capacity for containers being loaded.

This problem is solved in that the power supply unit is situated and secured in the region of the articulated coupling of the first and the second vehicle part, in particular above the common bogie, preferably in the middle between the first and the second container parking place or the containers placed thereon.

In this way, the free gap space present anyway between the containers of adjacent vehicle parts of an articulated vehicle is used to house the power supply unit. This space is large enough to accommodate a power supply unit which can power the cooling or heating system of a container for temperature-controlled goods. At the same time, in this way no space is taken up by the power supply unit beneath the container parking places or at other locations of the vehicle parts restricting the container parking places, so that the space available for the containers is not restricted by the power supply unit. Moreover, the power supply unit can be declared as being a charging unit in combined transport, so that the power supply unit is not viewed as being part of the articulated vehicle. Therefore, no adapting of the certification of the articulated vehicle is necessary, nor any changing or extension of the existing vehicle number when the power supply unit is combined with an already certified 3*o* articulated vehicle.

In one preferred embodiment, the power supply unit comprises a supporting structure and multiple power supply components fastened on or in the supporting structure. The supporting structure preferably has a closed housing form, such as a steel frame construction with outer cladding of sheet steel. By means of such a supporting structure, the power supply components can be protected and reliably secured to the articulated vehicle.

It is especially preferable for the supporting structure to be fastened by an adapter device to the articulated vehicle, preferably to the first or the second vehicle part. An adapter device allows a secure mounting of the power supply unit on the articulated vehicle, without this having to be modified significantly.

Moreover, it is preferable for the adapter device to comprise at least one adapter plate, preferably two adapter plates spaced apart in the transverse direction of the articulated vehicle, which is or are mounted, especially screwed, at the end of the first vehicle part facing toward the second vehicle part on its top side, and which protrudes or protrude toward the second vehicle part. Such adapter plates offer a secure base and mounting of the power supply unit in the area of the articulated coupling basically in the middle between the first and second vehicle part or the corresponding loaded containers.

Further, it is preferable for the adapter device, especially the adapter plate or adapter plates, to comprise mounting pins, preferably on their top side, and for the supporting structure to have corresponding pin receptacles, preferably on its bottom side, for engaging and preferably also for interlocking with the mounting pins. Preferably two adapter plates spaced apart in the transverse direction are provided, having two mounting pins apiece on their top side and able to engage and interlock with four corresponding pin receptacles provided on the supporting structure, preferably on the steel frame of the supporting structure. With such mounting pins and corresponding pin receptacles, the power supply unit can be securely, easily and quickly mounted on the adapter device and thus on the articulated vehicle.

It is furthermore preferable for the mounting pins to be container pins according to standard UIC 571-4. Such mounting pins come standard on the container parking places for the mounting of the containers. Preferably, the pin receptacles are also designed according to standard UIC 571-4. Such pin receptacles come standard on the bottom of the containers for engagement with the mounting pins. The use of such standardized connection elements has the advantage that they need not be separately certified.

In one preferred embodiment, the power supply components comprise at least one energy storage. With such an energy storage, the containers can be supplied with energy for a certain time totally independently of external energy sources. Furthermore, such an energy storage in chargeable form can be used as a buffer storage when connecting to an external power supply.

It is especially preferable for the energy storage to comprise at least one chargeable battery, preferably between three and seven high-power storage cell strings of LiFePO4 each with 9 kWh and modular storage capacity of 27 kWh to 63 kWh. Such a chargeable battery can provide electric energy for the containers when no outside power supply is available, and it can be charged when electric energy is available, either by its own electricity generation or through external electricity sources.

Moreover, it is especially preferable for the power supply components to comprise at least one electric generator, preferably an AC asynchronous generator with 22 kW, for charging the battery. The generator can be powered for example by kinetic energy from the movement of the articulated vehicle. In this way, the battery can be charged with its own generator provided in the power supply unit, for example during the movement of the articulated vehicle.

Preferably, the generator is operated with hydraulic pressure. Hydraulic pressure is especially suitable for operating a generator and it can be easily generated, for example, from kinetic energy.

Further, it is preferable for the articulated vehicle arrangement to comprise a hydraulic pump, especially an axial-piston constant pump, for providing the hydraulic pressure, being mounted in particular in a wheel set, preferably on a wheel set of the common bogie, and driven by the latter. Preferably, the hydraulic pump is mounted on the wheel hub and it picks off the kinetic energy from the rotation of the wheel there. Hydraulic hoses, especially three hydraulic hoses, are preferably provided for the connection of the hydraulic pump to the generator, which transport the hydraulic pressure from the hydraulic pump to the generator. With such a hydraulic pump on the wheel set, the hydraulic pressure delivered by the generator for the power generating can be provided easily and reliably, without requiring major modifications of the articulated vehicle.

In one preferred embodiment, the power supply components comprise at least one network charger, preferably a HF network charger with 10 kW, for charging the battery with external grid current. Preferably, the power supply components moreover comprise at least one corresponding charging port, preferably two CEE 5-pole charging receptacles, for connecting the network charger to an external network connection. With such a network charger and additional charging port, the battery can be charged from an external power supply. The charging of the battery through the network charger can be done in addition to the charging by means of a generator or independently of this.

In another preferred embodiment, the power supply components comprise at least one load connection, preferably four CEE 4-pole and/or 5-pole load boxes, preferably two for each side of the power supply unit, for connecting to a corresponding terminal on a container for the powering of a consumer, such as a cooling or heating system. In this way, each container can be easily and quickly connected to the power supply unit, even in the case when two containers are being charged for each vehicle part.

Another aspect of the present invention relates to an articulated vehicle for an articulated vehicle arrangement according to one of the previously described embodiments. The articulated vehicle comprises a first vehicle part and a second vehicle part. The first and the second vehicle part are coupled together by an articulated coupling about at least one vertical articulation axis and are braced in the region of the articulated coupling at their mutually facing ends, preferably on a common bogie. The first vehicle part comprises on its top side a first container parking place for one or more containers. As it were, the second vehicle part comprises on its top side a second container parking place for one or more containers. Moreover, the articulated vehicle comprises an adapter device for mounting a power supply unit for the autonomous power supply of containers loaded on the articulated vehicle. The adapter device is arranged in the area of the articulated coupling, preferably above the common bogie, preferably in the middle between the first and the second container parking place or the containers placed thereon and fastened preferably to the first vehicle part. The features and effects already described in connection with the articulated vehicle arrangement also hold with regard to the articulated vehicle.

Another aspect of the present invention relates to a power supply unit for an articulated vehicle arrangement according to one of the previously described embodiments, comprising a preferably closed supporting structure and multiple power supply components fastened on or in the supporting structure, the supporting structure being designed to be mounted by an adapter device on an articulated vehicle of the articulated vehicle arrangement. The features and effects already described in connection with the articulated vehicle arrangement also hold with regard to the power supply unit.

Figure 2:
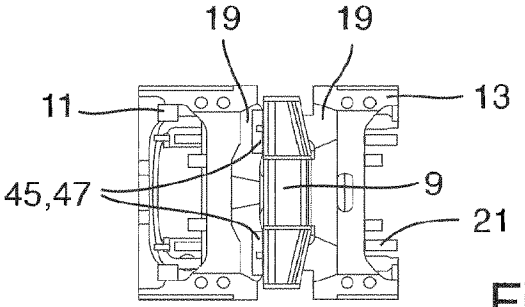
Figure 3:
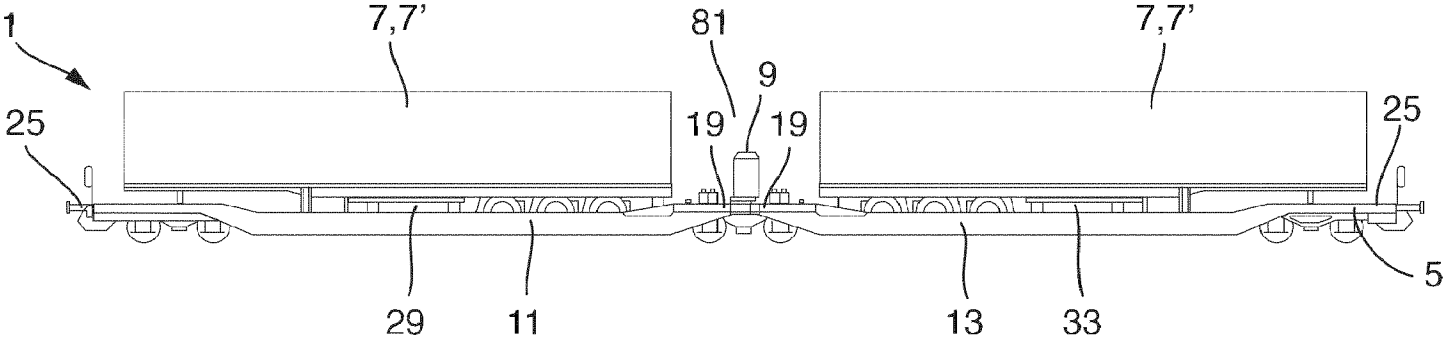
Figure 4:
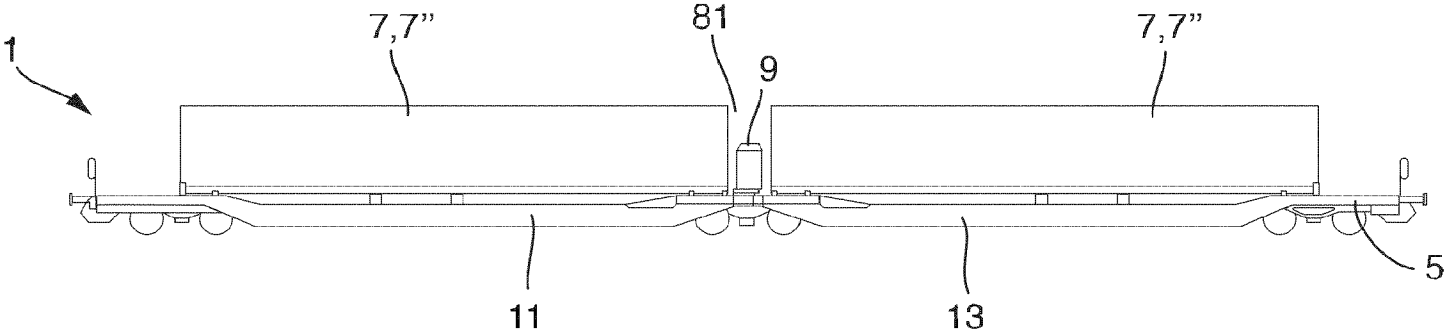
Figure 5:
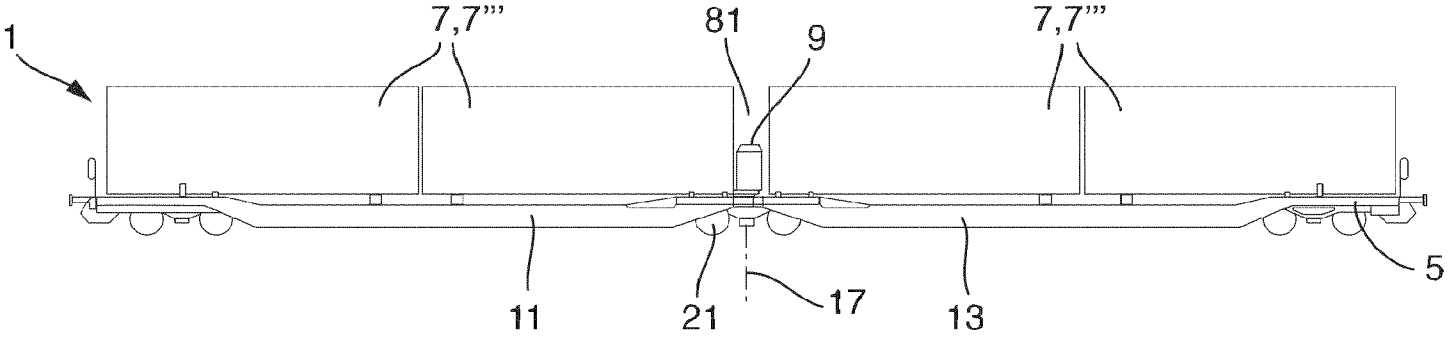
Figure 6:
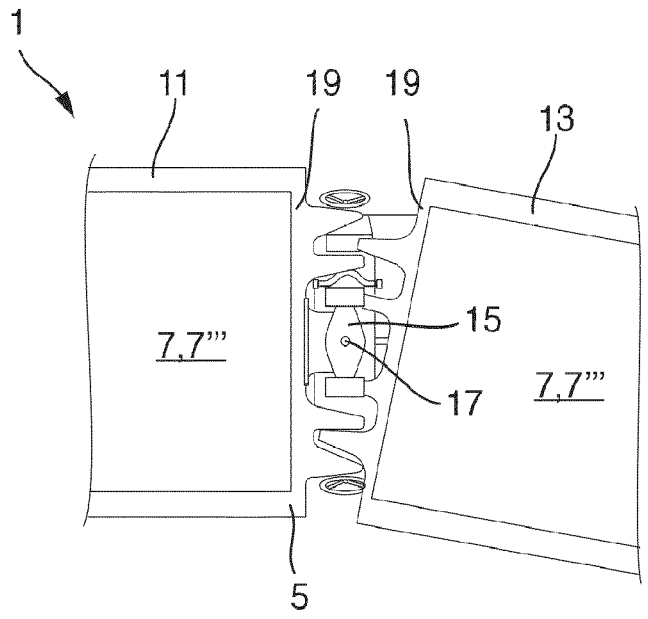
Figure 7:
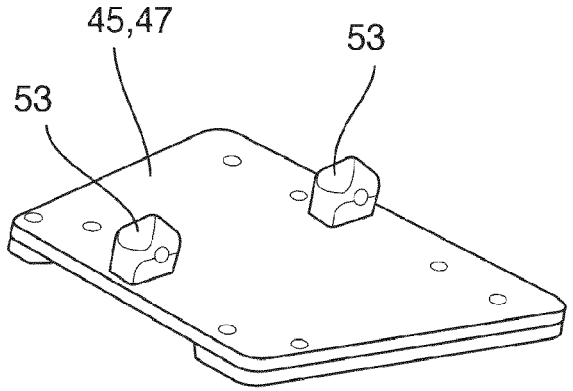
Figure 8:
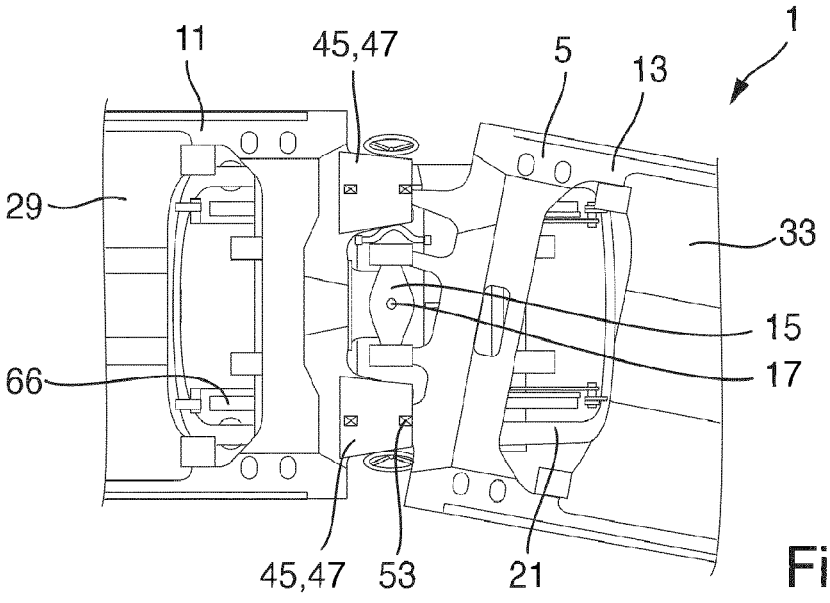
Figure 9:
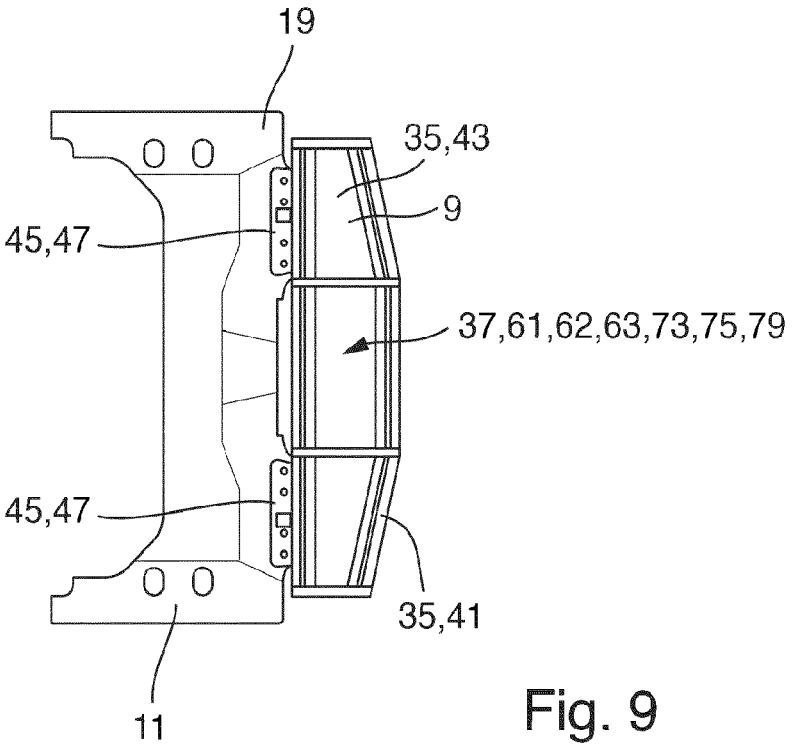
Figure 10:
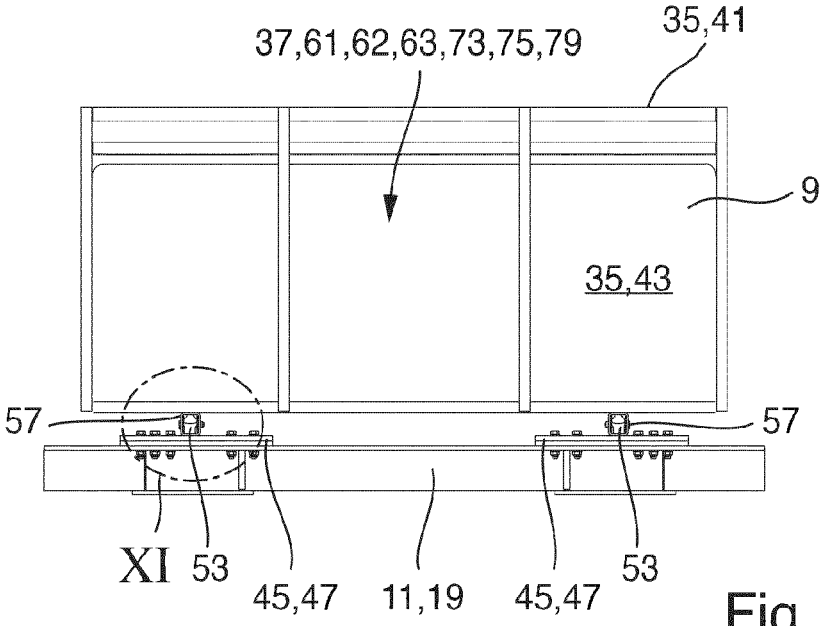
Figure 11:
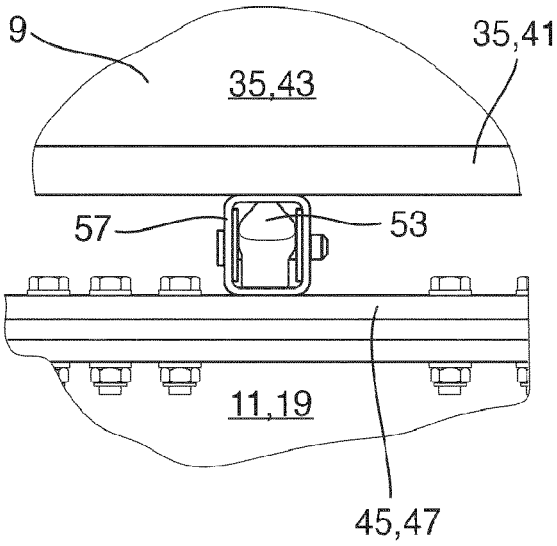
Figure 12:
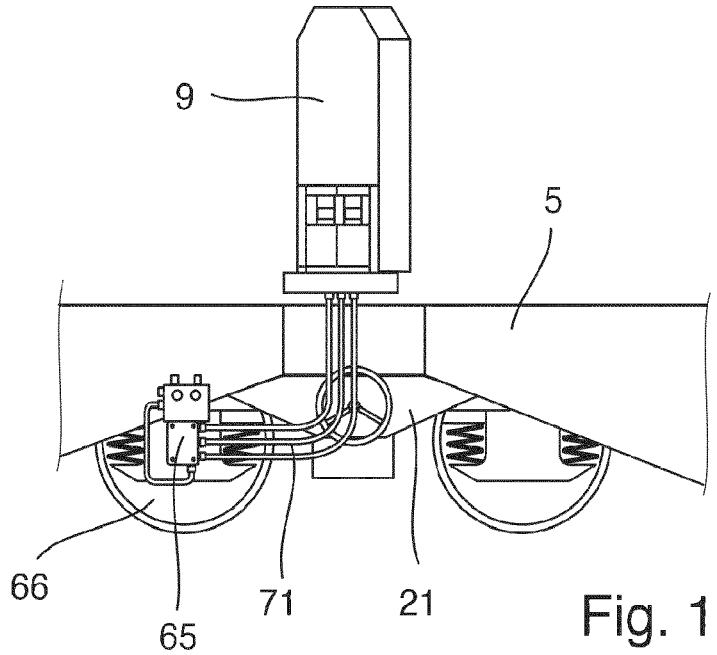
Figure 13:
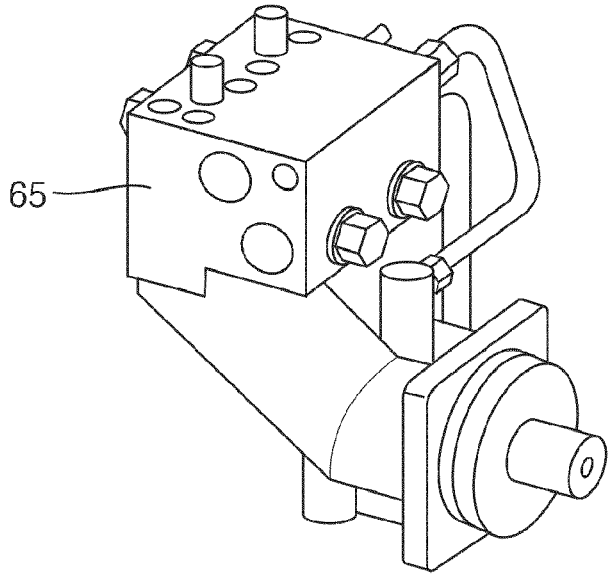
Figure 14:
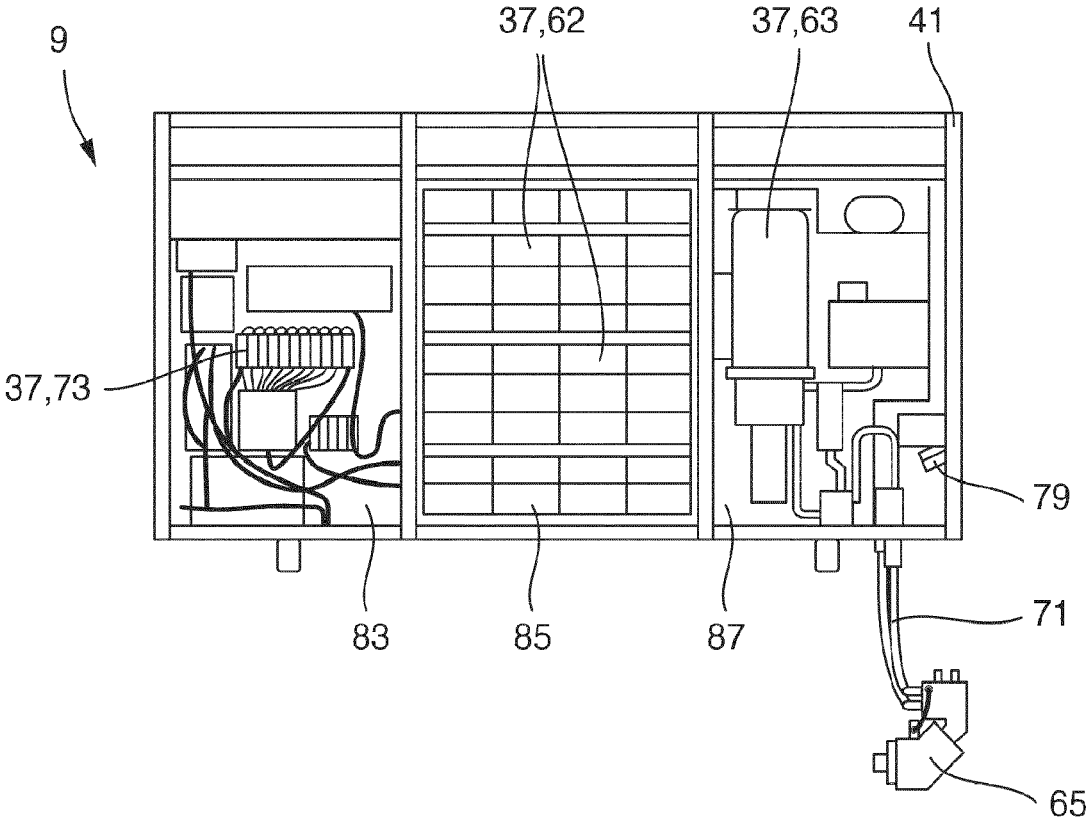

Preferred exemplary embodiments of the present invention will be explained more closely below with the aid of a drawing. The drawing shows:

FIG. 1 a side view of an articulated vehicle arrangement according to one embodiment of the invention, FIG. 2 a detail top view of the region of the articulated coupling of the articulated vehicle arrangement of FIG. 1 with the power supply unit situated there, FIG. 3 a side view of the articulated vehicle arrangement of FIG. 1 loaded with two refrigerated semi-trailers, FIG. 4 a side view of the articulated vehicle arrangement of FIG. 1 loaded with two reefer containers, FIG. 5 a side view of the articulated vehicle arrangement of FIG. 1 loaded with four refrigerated swap bodies, FIG. 6 a detail top view of the region of the articulated coupling of the articulated vehicle arrangement of FIG. 5 without power supply unit, FIG. 7 a perspective view of an isolated adapter plate for mounting a power supply unit on an articulated vehicle according to the invention, FIG. 8 a detail top view of the region of the articulated coupling of the articulated vehicle arrangement of FIG. 1 with adapter plates mounted there but without the power supply unit, FIG. 9 an isolated top view of the end of the first vehicle part of the articulated vehicle arrangement of FIG. 1 and the power supply unit mounted there, FIG. 10 an isolated front view of the end of the first vehicle part of the articulated vehicle arrangement of FIG. 1 and the power supply unit mounted there, FIG. 11 a detail view of the mounting of the power supply unit at the end of the first vehicle part of FIG. 10 with a view of a mounting pin of an adapter plate engaging with a pin receptacle of a container, FIG. 12 a side view of an articulated vehicle arrangement according to the invention with a view of a hydraulic pump mounted on the wheel set FIG. 13 a perspective isolated view of the hydraulic pump of FIG. 12 and FIG. 14 a front view of a power supply unit according to the invention with cutaway supporting structure and a view of the power supply components inside the supporting structure.

FIGS. 1 and 2 show an articulated vehicle arrangement 1 according to the invention for a rail freight train. The articulated vehicle arrangement 1 comprises an articulated vehicle 5 for the transport of containers 7, also known as a container carrier (CTW), as well as a power supply unit 9 for the electric power supply of containers 7 loaded on the articulated vehicle 5. Such containers 7 may be refrigerated semi-trailers 7', for example, as shown in FIG. 3, so-called reefer containers 7", as shown in FIG. 4, refrigerated swap bodies 7'", as shown in FIG. 5, or tank containers.

The articulated vehicle 5 comprises a first vehicle part 11 and a second vehicle part 13, the first and the second vehicle part 11, 13 being coupled together by an articulated coupling 15 about a vertical articulation axis 17 and braced in the region of the articulated coupling 15 on a common bogie 21 at their mutually facing ends 19. Additional bogies 23 are provided at the ends 25 of the two vehicle parts 11, 13 facing away from each other. The first vehicle part 11 comprises on its top side a first container parking place 29 for one or more containers 7 and the second vehicle part 13 comprises on its top side a second container parking place 33 for one or more containers 7.

The power supply unit 9 is designed for the autonomous electric power supply of the containers 7 without resorting to a power supply of the locomotive, another articulated vehicle, or the overhead contact line. The power supply unit 9 is arranged and mounted in the area of the articulated coupling 15 of the first and second vehicle part 11, 13 above the common bogie 21 in the middle between the first and the second container parking place 29, 33 or the containers 7 placed thereon, as can be seen in FIG. 1 to 5. FIG. 6 shows an unimpeded top view of the articulated coupling 15.

As can be seen for example from FIGS. 9 and 10, the power supply unit 9 comprises a supporting structure 35 and multiple power supply components 37 fastened on or in the supporting structure 35. The supporting structure 35 has a closed housing form, formed by a welded steel frame construction 41 with outer cladding 43 of sheet steel.

The supporting structure 35 is fastened by an adapter device 45 to the articulated vehicle 5, as is shown in FIG. 7 to 11. It is shown in FIGS. 7 and 8 that the adapter device 45 comprises two adapter plates 47 spaced apart in the transverse direction of the articulated vehicle 5, which are mounted at the end 19 of the first vehicle part 11 facing toward the second vehicle part 13 on its top side, and which protrude toward the second vehicle part 13. The adapter plates 47 comprise two mounting pins 53 on their top side and the supporting structure 35 has four corresponding pin receptacles 57 on the bottom side of the steel frame construction 41, for engaging and interlocking with the mounting pins 53, as can be seen in FIGS. 10 and 11. The mounting pins 53 are formed as container pins according to standard UIC 571-4, such as come standard on the container parking places 29, 33 for fastening the containers 7. The pin receptacles 57 are also designed according to standard UIC 571-4, so that a standard connection is formed between the mounting pins 53 and the pin receptacles 57.

The power supply components 37 comprise an energy storage 61 with multiple chargeable batteries 62, especially between three and seven high-power storage cell strings of LiFePO4 each with 9 kWh and modular storage capacity of 27 kWh to 63 kWh. The power supply components 37 moreover comprise an electric generator 63 for charging the batteries 62, especially an AC asynchronous generator with 22 kW. The generator 63 is operated by hydraulic pressure from the kinetic energy of movement of the articulated vehicle 5.

In order to provide the hydraulic pressure for operating the generator 63, the articulated vehicle arrangement 1 comprises a hydraulic pump 65, especially an axial-piston constant pump, which is mounted on a wheel set 66 of the common bogie 21 and operated by it, as shown in FIG. 12. FIG. 13 shows the hydraulic pump 65 all by itself. The hydraulic pump 65 is mounted on the wheel hub, where it picks off the kinetic energy from the rotation of the wheel set 66 and transforms this into hydraulic energy or hydraulic pressure, which is then taken to the generator 63 and operates it. Three hydraulic hoses 71 are provided for connecting the hydraulic pump 65 to the generator 63, taking the hydraulic pressure from the hydraulic pump 65 to the generator 63.

Moreover, the power supply components 37 comprise a network charger 73, especially a HF network charger with 10 kW, for charging the battery 62 with external grid current. Furthermore, the power supply components 37 comprise at least one corresponding charging port 75, especially two 5-pole CEE load boxes, for connecting the network charger 73 to an external network connection.

Furthermore, the power supply components 37 comprise at least one load connection 79, especially four 4-pole and/or 5-pole CEE load boxes, two for each side of the power supply unit 9, for connecting to a corresponding terminal on a container 7 to supply power to a consumer, such as a cooling or heating system of the containers.

Besides the aforementioned ones, the following additional power supply components 37 are also provided: at least one inverter, especially two 30 kW mobile drive dual inverters, for the generator operation and the air conditioning system operation; at least one regulator unit, especially a PMU-8-Dreifels controller with separate 24 V onboard storage cell and standby management, for the system management and monitoring; at least one operator and monitoring module for starting the power supply unit 9 and monitoring the operating state.

FIG. 14 shows the arrangement of the power supply components 37 inside the power supply unit 9. The power supply components are arranged here in three separate compartments 83, 85, 87. In a first compartment 83 on the left side are arranged the electronics and controls, especially the inverter, regulator unit, operating and monitoring module, and network charger 73. In a second compartment 85 in the middle are housed the batteries 62, especially the high-power storage cell strings, which are arranged in multiple drawers in a grid beneath and alongside each other and are separately removable. In a third compartment 87 on the right side are arranged the generator 63 and hydraulic hoses 71. FIG. 14 likewise shows the hydraulic pump 65, which is connected by the hydraulic hoses 71 to the generator. Furthermore, a load connection 79 can be seen on the right side of the third compartment 87.

With the above-described articulated vehicle arrangement 1 an uninterrupted power supply can easily be assured for loaded containers 7 even at standstill and in shunting operation. Moreover, the free gap space 81 between the containers 7 of adjacent vehicle parts 11, 13 of an articulated vehicle 5 is used to accommodate the power supply unit 9. This space 81 is large enough to accommodate a power supply unit 9 which can power the cooling or heating system of a container 7 for temperature-controlled goods. At the same time, in this way no space is taken up beneath the container parking places 29, 33 or at other locations of the vehicle parts 11, 13 restricting the container parking places 29, 33 by the power supply unit 9, so that the available space for the containers 7 is maximized.

The invention claimed is:

1. An articulated vehicle arrangement for a rail freight train, comprising:

an articulated vehicle for the transporting of containers having a first vehicle part and a second vehicle part, an articulating coupling, wherein the first and the second vehicle part are coupled together by the articulated coupling about a vertical articulation axis, wherein the first vehicle part comprises a first container parking place on a top side for one or more containers and wherein the second vehicle part comprises a second container parking place on a top side for one or more containers, a power supply unit for supplying power to the containers loaded on the articulated vehicle, wherein the power supply unit is situated in the region of the articulated coupling of the first and the second vehicle part between the first and the second container parking place, wherein the power supply unit is supported on a supporting structure and fastened by an adapter device to the articulated vehicle, wherein the adapter device comprises a plurality of mounting pins, and wherein the supporting structure comprising a plurality of pin receptacles for engaging with the corresponding mounting pin of the plurality of mounting pins.

2. The articulated vehicle arrangement according to claim 1, wherein the power supply unit comprises multiple power supply components fastened to the supporting structure.

3. The articulated vehicle arrangement according to claim 2, wherein the power supply components comprise at least one energy storage.

4. The articulated vehicle arrangement according to claim 3, wherein the energy storage comprises at least one chargeable battery.

5. The articulated vehicle arrangement according to claim 4, wherein the power supply components comprise at least one electric generator for charging the battery.

6. The articulated vehicle arrangement according to claim 5, wherein the generator is operated with hydraulic pressure.

7. The articulated vehicle arrangement according to claim 6, wherein the articulated vehicle arrangement comprises a hydraulic pump for providing the hydraulic pressure, being mounted in a wheel set and driven by the latter.

8. The articulated vehicle arrangement according to claim 4, wherein the power supply components comprise at least one network charger for charging the battery with external grid current and at least one corresponding charging port for connecting to an external network connection.

9. The articulated vehicle arrangement according to claim 4, wherein the power supply components comprise at least one load connection for connecting to a corresponding terminal on a container.

10. The articulated vehicle arrangement according to claim 1, wherein the adapter device comprises at least one adapter plate, which is or are mounted at the end of the first vehicle part and protrudes or protrude toward the second vehicle part.

11. The articulated vehicle arrangement according to claim 1, wherein the mounting pins are container pins according to standard UIC 571-4.

12. An articulated vehicle for an articulated vehicle arrangement according to claim 1, comprising a first vehicle part and a second vehicle part, wherein the first and the second vehicle parts are coupled together by an articulated coupling about a vertical articulation axis, wherein the first vehicle part comprises on its top side a first container parking place for one or more containers, wherein the second vehicle part comprises on its top side a second container parking place for one or more containers, wherein the articulated vehicle comprises an adapter device for mounting a power supply unit for the autonomous power supply of containers loaded on the articulated vehicle, and wherein the adapter device is situated in the area of the articulated coupling between the first and the second container parking place.

13. A power supply unit for an articulated vehicle arrangement according to claim 1, comprising a supporting structure and multiple power supply components fastened to the supporting structure, wherein the supporting structure is adapted to be fastened by an adapter device to an articulated vehicle of the articulated vehicle arrangement.

* * * * *